US009420854B1

(12) United States Patent
Sloan

(10) Patent No.: US 9,420,854 B1
(45) Date of Patent: Aug. 23, 2016

(54) ZIPPER REPLACEMENT DEVICE

(71) Applicant: Jill Sloan, Kernville, CA (US)

(72) Inventor: Jill Sloan, Kernville, CA (US)

( * ) Notice: Subject to any disclaimer, the term of this patent is extended or adjusted under 35 U.S.C. 154(b) by 0 days.

(21) Appl. No.: 14/957,725

(22) Filed: Dec. 3, 2015

Related U.S. Application Data

(60) Provisional application No. 62/173,602, filed on Jun. 10, 2015.

(51) Int. Cl.
*A44B 19/24* (2006.01)
*A44B 19/02* (2006.01)
*A44B 19/34* (2006.01)

(52) U.S. Cl.
CPC ..... *A44B 19/24* (2013.01); *A44B 19/02* (2013.01); *A44B 19/34* (2013.01); *Y10T 24/2539* (2015.01); *Y10T 24/2559* (2015.01)

(58) Field of Classification Search
CPC ..... A44B 19/02; A44B 19/04; A44B 19/06; A44B 19/08; A44B 19/34; A44B 19/24; Y10T 24/2502; Y10T 24/2504; Y10T 24/2505; Y10T 24/2516; Y10T 24/2539; Y10T 24/2557; Y10T 24/2593; Y10T 24/2596; Y10T 24/255
See application file for complete search history.

(56) References Cited

U.S. PATENT DOCUMENTS

| | | | |
|---|---|---|---|
| 3,538,914 | A | 11/1970 | Myers |
| 5,745,960 | A | 5/1998 | Dishner et al. |
| 2010/0269312 | A1 | 10/2010 | Wagner et al. |
| 2013/0318751 | A1 | 12/2013 | Lin |

*Primary Examiner* — Abigail Morrell
(74) *Attorney, Agent, or Firm* — Daniel Boudwin; Global Intellectual & Property Agency

(57) ABSTRACT

A device to replace a broken section of zipper. The present invention includes a track with an inner surface and an outer surface. A plurality of teeth are disposed along the inner surface of the track. A groove extends across the outer surface of the track and creates an inner volume in the track. The inner volume is configured to receive the teeth of the broken zipper section therein. Flanges that extend from an upper portion and a lower portion of the track into the groove help to secure the track in place. Further, a stop at an end of the track is used to attach the zipper replacement device to the material containing the broken zipper.

11 Claims, 3 Drawing Sheets

ZIPPER REPLACEMENT DEVICE

CROSS REFERENCE TO RELATED APPLICATIONS

This application claims the benefit of U.S. Provisional Application No. 62/173,602 filed on Jun. 10, 2015. The above identified patent application is herein incorporated by reference in its entirety to provide continuity of disclosure.

BACKGROUND OF THE INVENTION

The present invention relates to zippers. More specifically, the present invention relates to a device for replacing damaged or otherwise inoperable zippers.

Zippers are frequently used in the textile industry. Although zippers used today are quite durable, many people have encountered a damaged or broken zipper. The teeth of the zipper may become bent or chipped after extended use, and one or more teeth may fall off of the zipper. Objects having broken or worn-out zippers that can no longer be closed can be rendered almost entirely useless. Therefore, users have the option to either discard the object entirely or replace the entire zipper.

However, discarding the object is frustrating when it is a highly desired or new object. Replacing the entire zipper can be extremely difficult without the proper sewing skills. Users often have to pay high maintenance expenses and leave their garment at a repair facility for an undesirably long period of time. Therefore, there is a need for a convenient and efficient means for replacing a broken section of a zipper.

Zipper repair devices and methods are known in the prior art. The prior art describes devices and methods for removing a zipper slider. The prior art also discloses fastening devices for securing two articles together utilizing a cohesive means. However, the prior art does not address the problem of replacing a broken section of zipper apart from the zipper slider. Therefore, there is a need in the prior art for a device that can replace the broken track or teeth of a zipper.

SUMMARY OF THE INVENTION

In view of the foregoing disadvantages inherent in the known types of zipper repair devices and methods now present in the prior art, the present invention provides an apparatus adapted for placement over the teeth of an existing zipper wherein the user can smoothly transition the zipper slider from the existing section to the replacement section. The present system comprises a track with teeth dispersed across the inner surface of the track and a groove extending into the outer surface of the track.

The broken section of zipper can be fed into an inner volume that extends up from the groove into the teeth of the device. Edges that extend from the track prevent the track from pulling inward off the broken section of zipper when teeth on complimentary tracks are mated. A stop at an end of the track is used to keep the track in place and prevent a zipper slider from sliding off the length of the zipper.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
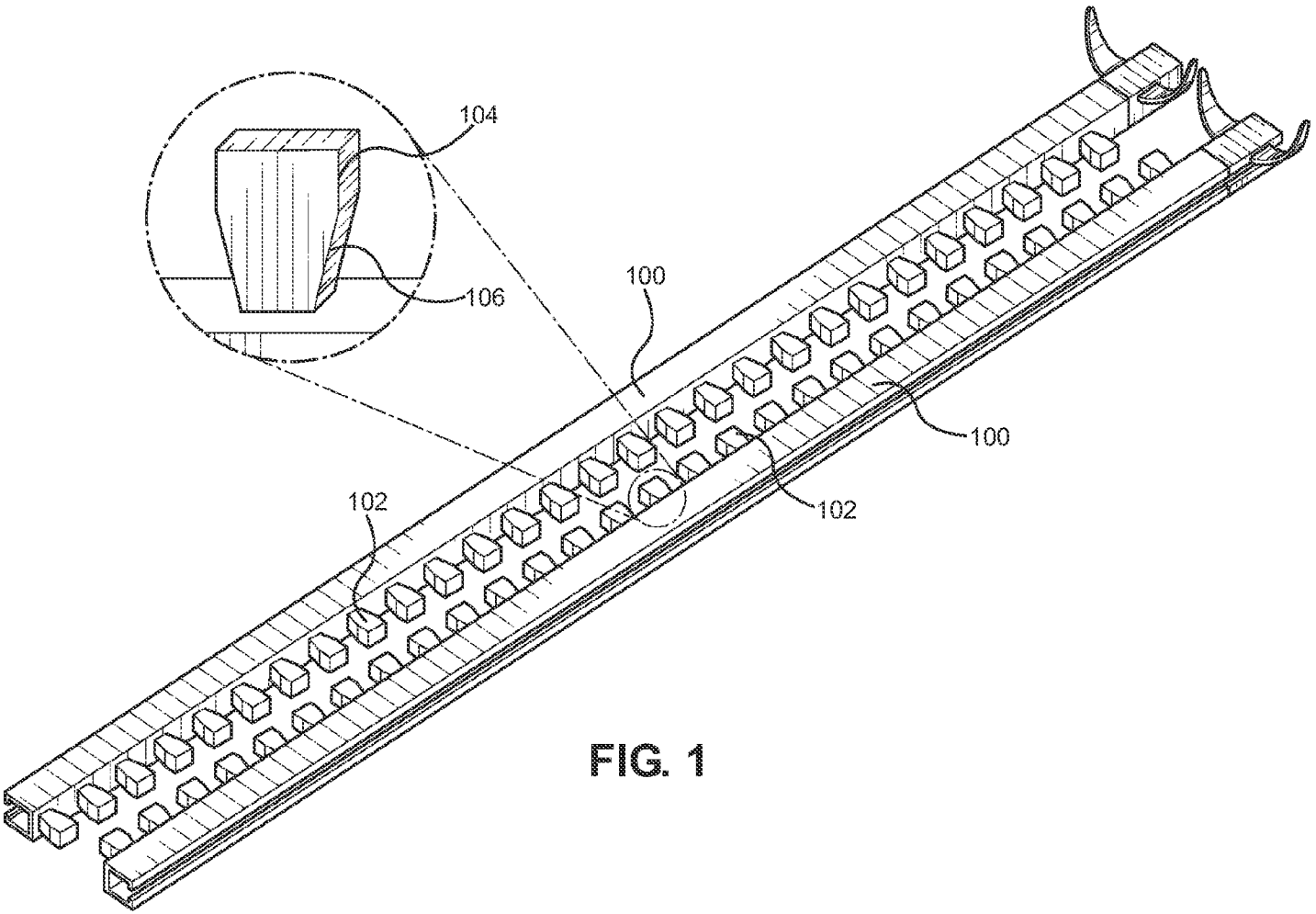
FIG. 1 shows a perspective view of the zipper replacement device.

Reference is made herein to the attached drawings. Like reference numerals are used throughout the drawings to depict like or similar elements of the zipper replacement device. For the purposes of presenting a brief and clear description of the present invention, the preferred embodiment will be discussed as used for replacing a broken section of a zipper. The figures are intended for representative purposes only and should not be considered to be limiting in any respect.

Referring now to FIG. 1, there is shown a perspective view of the zipper replacement device. The present invention comprises a pair of complementary tracks 100 having an inner surface and an outer surface. The tracks 100 are plastic and rigid yet still retain some flexibility. In various embodiments, the tracks are the length of an entire damaged zipper or only the length of a small damaged portion of a zipper.

Each track 100 has a plurality of interlocking teeth 102 disposed along the inner surface. The teeth 102 are adapted to replace the damaged zipper's teeth for use as a replacement zipper. The teeth 102 are spaced at a fixed interval in a configuration for mating with an opposing set of zipper teeth on the complementary track. In the depicted embodiment, the teeth 102 are uniform in shape, having a top portion 104 and a bottom portion 106 wherein the top portion 104 has a width larger than a width of the bottom portion 106. The difference in width allows the teeth 102 on complementary tracks to interlock when mated.

Figure 2:
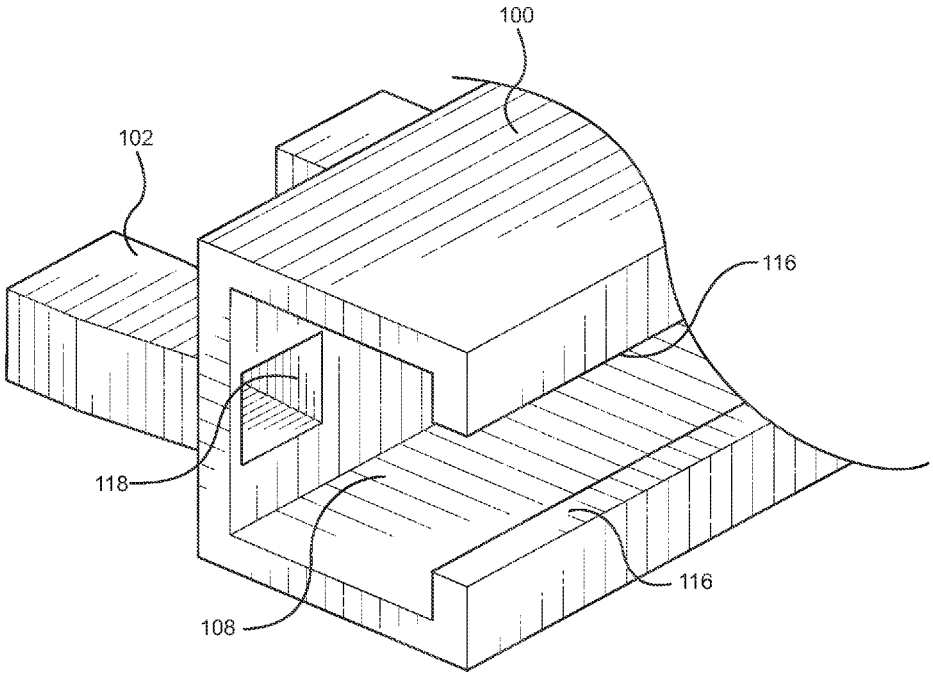
FIG. 2 shows a side view of the zipper replacement device.

Referring now to FIG. 2, there is shown a cross-sectional view of the present invention. Each track 100 also has a groove 108 disposed on the outer surface that extends longitudinally thereacross. The teeth 102 have an inner volume 118 that extends down into the groove 108. This allows the user to place the track 100 of the present invention over the top of a broken section of zipper. The teeth of the broken zipper are inserted through the groove 108 to fill the inner volume 118. Thus, the present invention simulates a mold of the broken zipper. Once the teeth of the broken section of zipper fill the inner volume of those in the present invention, lateral movement is restricted because the replacement zipper device will catch on each one of the teeth of the broken zipper.

Further, a pair of flanges 116 extend perpendicularly from an upper portion and a lower portion of the track 100 and into the groove 108. In the depicted embodiment, the flanges are aligned, but do not meet. The flanges 116 extend the entire length of the track 100. The flanges 116 aid in preventing the replacement zipper device from pulling inward and off the broken zipper section when the teeth 102 of the complementary tracks 100 interlock.

Figure 3:
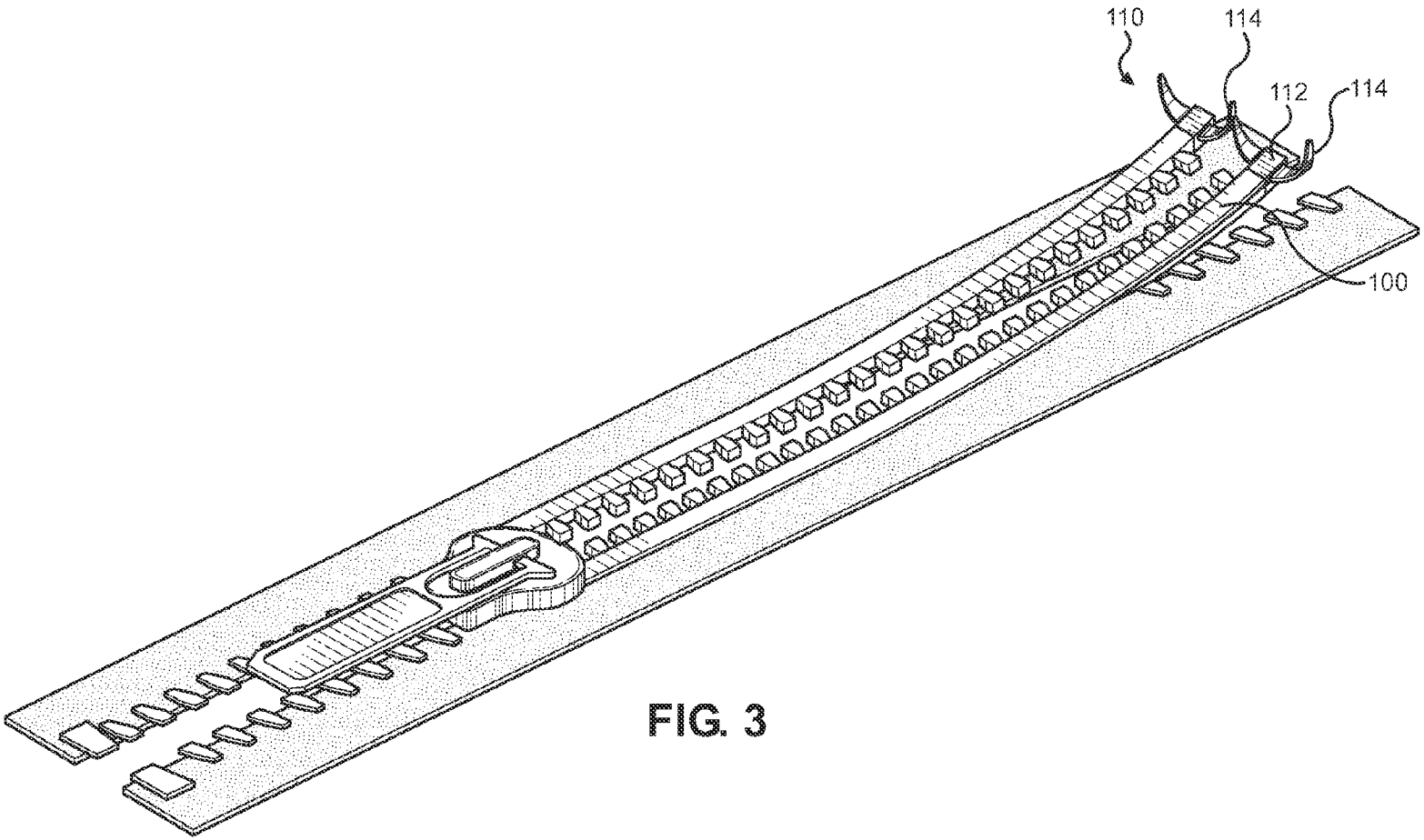
FIG. 3 shows a perspective view of the zipper replacement device secured to a section of broken zipper.

Referring now to FIG. 3, there is shown a perspective view of the zipper replacement device secured to a section of broken zipper. The track 100 of the replacement zipper device has a pair of ends. In the depicted embodiment, there is a stop 110 at one end of the track 100. In various embodiments, there is additionally a stop 110 at the opposing end of the track 100. The stop is made of a malleable metal and comprised of a flat base 112 with a plurality of prongs 114 extending from the base. The stop 110 is used to secure the device in place and also to prevent a zipper slider from sliding off the track 100. To secure the zipper replacement device in place, the prongs first penetrate the material attached to the broken zipper. Next, the prongs are bent thereby gripping the material.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A zipper replacement device, comprising:

a track having an inner surface and an outer surface;

a groove extending along the outer surface of the track; and a plurality of teeth disposed on the inner surface of the track;

wherein the teeth have an inner volume that extends down into the groove, the inner volume is adapted to receive teeth of a damaged zipper therein.

2. The zipper replacement device of claim 1, wherein the track has an upper portion and a lower portion whereby a pair of flanges extends from the upper portion and the lower portion into the groove for use in securing the damaged zipper therein.

3. The zipper replacement device of claim 2, wherein the flanges extend perpendicularly from the track.

4. The zipper replacement device of claim 2, wherein the flanges are aligned.

5. The zipper replacement device of claim 1, further comprising a stop connected to an end of the track, the stop having a base and a plurality of prongs extending from the base.

6. The zipper replacement device of claim 5, wherein the stop is made of a malleable metal.

7. The zipper replacement device of claim 1, wherein the teeth are spaced at fixed intervals.

8. The zipper replacement device of claim 1, wherein the teeth are configured for mating with an opposing set of teeth on a complementary track.

9. The zipper replacement device of claim 1, wherein the teeth have a top portion and a bottom portion, the top portion having a width larger than a width of the bottom portion.

10. The zipper replacement device of claim 1, wherein the teeth are uniform in shape.

11. The zipper replacement device of claim 1, wherein the track is composed of a flexible material.

* * * * *